US005806475A

United States Patent [19]

Hausknecht

[11] Patent Number: 5,806,475

[45] Date of Patent: Sep. 15, 1998

[54] LOW FRICTION ROCKER ARM ASSEMBLY

[76] Inventor: Louis A. Hausknecht, 1011 Sundance Dr., Miamisburg, Ohio 45342

[21] Appl. No.: 611,455

[22] Filed: Mar. 22, 1996

[51] Int. Cl.[6] ..... F01L 1/18; F01L 13/00

[52] U.S. Cl. ..... 123/90.16; 123/90.41

[58] Field of Search ..... 123/90.15, 90.16, 123/90.39, 90.41; 74/519, 559

[56] References Cited

U.S. PATENT DOCUMENTS

| | | | |
|---|---|---|---|
| 4,515,346 | 5/1985 | Gaterman, III | 251/337 |
| 4,519,345 | 5/1985 | Walter | 123/90.39 |
| 4,655,176 | 4/1987 | Sheeshan | 123/90.39 |
| 4,718,379 | 1/1988 | Clark | 123/90.41 |
| 4,784,095 | 11/1988 | Golding et al. | 123/90.41 |
| 4,944,257 | 7/1990 | Mills | 123/90.41 |
| 5,010,857 | 4/1991 | Hempelmann et al. | 123/90.41 |
| 5,074,261 | 12/1991 | Hamburg et al. | 123/90.41 |
| 5,188,068 | 2/1993 | Gaterman, III et al. | 123/90.35 |
| 5,560,265 | 10/1996 | Miller | 123/90.41 |

OTHER PUBLICATIONS

*The Rocker Arm Question: Extruded or Forged?*, Advertisement of Crane Cams, Incorporated, Date Unknown.

*Primary Examiner*—Weilun Lo
*Attorney, Agent, or Firm*—Reese Taylor

[57] ABSTRACT

A rocker arm assembly includes a stamped body comprising elongate, spaced plates with a pushrod engaging block at one end and a valve stem engaging roller at the other. A stud mounting block is located at about the midpoint of the body between the two ends. The pushrod engagement block has an off-center rod engaging recess so that it can be reversed to alter the operating ratio of the arm. The block also has an internal network of bores to facilitate reception of lubricant from the pushrod to flow into and through the block. The stud mounting block is bored so as to provide for the body of the rocker arm to be pivotally mounted on the stud, thereby reducing friction and heat buildup during operation.

14 Claims, 3 Drawing Sheets

LOW FRICTION ROCKER ARM ASSEMBLY

RELATED PATENT APPLICATIONS

None.

1. BACKGROUND OF THE INVENTION

This invention relates in general to rocker arms for automotive use and relates in particular to a low cost and low friction rocker arm assembly.

2. DESCRIPTION OF THE PRIOR ART

In the art of internal combustion engines, it is known to provide a camshaft which rotates as the engine operates, is operatively connected to the crankshaft and ultimately controls opening and closing of the engine valves through engagement with a rocker arm. The rocker arm is pivotally mounted to the engine cylinder head itself and has one end connected to or in engagement with the pushrod and the other end connected to or in engagement with the projecting end of the valve stem. As the pushrod is driven by the rotation of its associated cam, it alternately opens and controls the closure of the valve through the pivoting rocker arm.

These rocker arms are generally cast, forged, extruded or deep-stamped and are relatively expensive, particularly when designed for use in high performance engines. In that regard, each arm pivots many times per minute depending upon, of course, the rpms of the engine. One difficulty that is encountered is that generally, in conventional construction, the rocker arm, which is elongate, has a relatively large, hemispherical portion adjacent its longitudinal midpoint about which the arm pivots and a fairly high degree of friction at that pivot point. While these rocker arms are lubricated, there is still a serious wear problem created in this area. Some attempts have been made to relieve this problem by utilizing an oversized nut on the stud which holds the rocker arm to the engine cylinder head itself so as to dissipate the heat buildup and thereby minimize the friction. However, this is not entirely satisfactory in practice.

Additionally, the interconnection or engagement of the one end of the rocker arm with the valve stem is another area of heat buildup and consequent friction increase. In many instances, attempts have been made to resolve this problem by mounting a roller on that end of the rocker arm so that there is rolling rather than sliding friction engagement between the arm and the projecting end of the valve stem.

At the opposed end of the rocker arm another problem is often encountered in that generally a cup-shaped recess is formed to receive the projecting end of the pushrod. Again, heat builds up, especially in high rpm operations, and it is a problem to lubricate sufficiently to avoid galling in this area.

Finally, it should be noted that, in high speed or high performance operations, the ratio of the distance from the pivot or fulcrum point of the rocker arm to the end of the rocker arm which engages pushrod, as compared to the distance from the pivot or fulcrum point to the end of the arm which engages the valve stem, is critical to high performance operation. Therefore, the higher the performance desired, the higher the ratio required. That is, a rocker arm with a valve stem point of contact 1.6 times the distance from the fulcrum point compared to the distance from the pushrod seat to the fulcrum point will open the valve farther than one with a 1.5:1 ratio. In the prior art, when engine modification for increased performance is desired, it is necessary to provide an entirely different set of rocker arms of different pushrod seat positions so as to provide a different ratio, and it is believed desirable to make it possible to avoid that expense by providing a means by which the ratio can be altered by simply repositioning the pushrod seats of the existing rocker arms.

It is also believed desirable to provide a means for reducing the friction by improving the lubrication of the rocker arm assembly, both at the fulcrum point and at both ends of the rocker arm where the arm engages the pushrod and the valve stem.

Finally, it is believed desirable to reduce the cost of the normal cast and deep-stamped type rocker arm assemblies currently available by providing an assembly in which most of the components are stamped in lighter, simpler and less expensive shapes.

SUMMARY OF THE INVENTION

It accordingly becomes a principal object of this invention to provide a low friction, low cost, adaptable rocker arm assembly.

To that end, it has first been found that the usual cast assemblies can be replaced by simple stamped plate assemblies in which the rocker arm itself is comprised of two opposed, spaced, elongate, identical legs or plates interconnected at about their longitudinal midpoints by a stud engaging assembly which provides means for securing the arm to the engine cylinder head so that the arm assembly may freely pivot about its transverse axis.

It has further been found that a pushrod engaging block can be fitted between the legs of the arm assembly at one end and provided with a hemispherical rod engaging surface and lubricating bores.

It has been further found that this pushrod engaging member can be provided with spaced transverse bores so that the pushrod engaging block can be reversed so as to alter the distance from its point of engagement with the pushrod to the pivot or fulcrum point of the overall arm assembly.

It has also been found that the opposed end of the arm assembly can be journalled to receive a roller structure for engagement with the valve stem.

Accordingly, production of an improved rocker arm assembly of the type above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
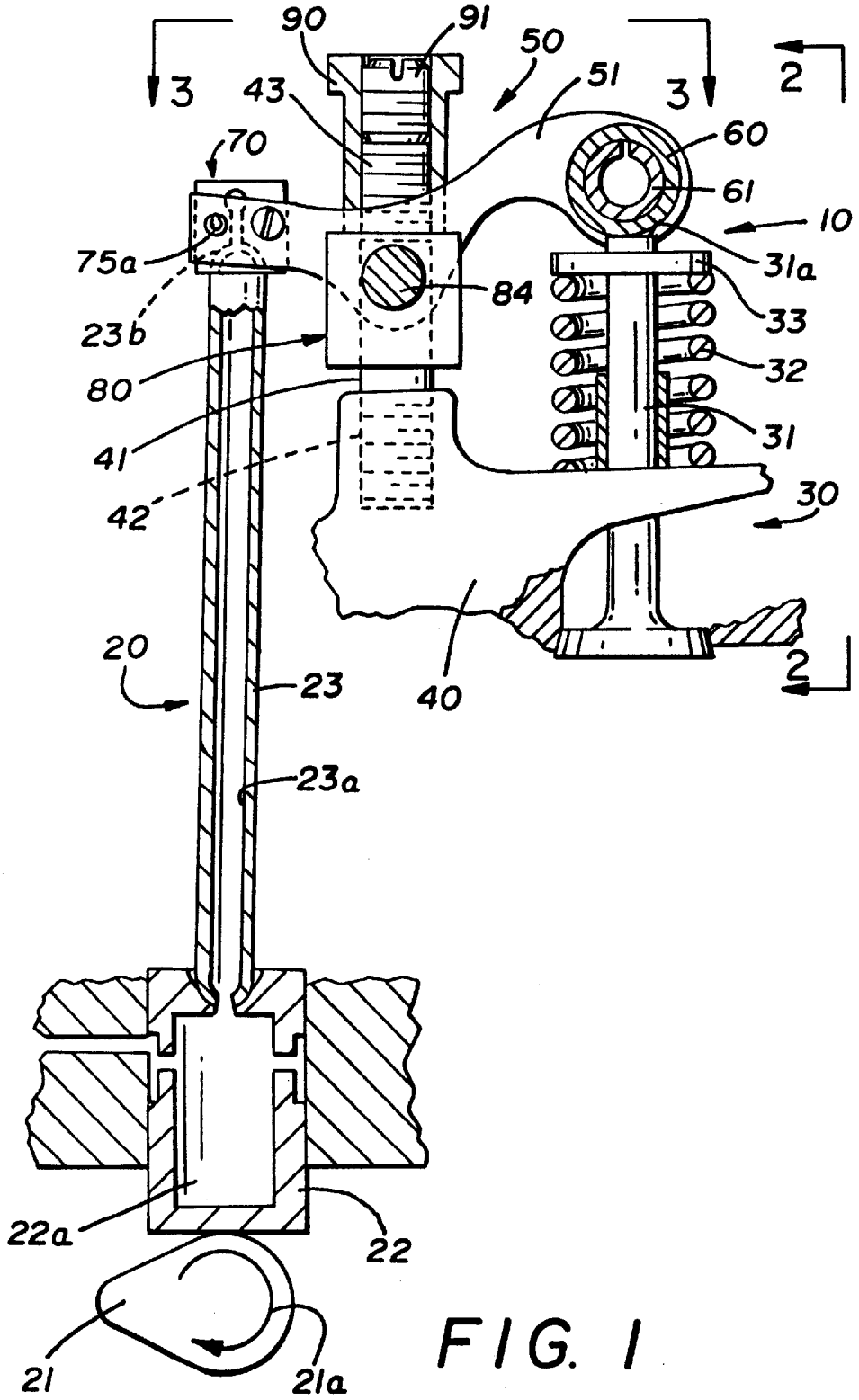
FIG. 1 is an elevational view of the improved rocker arm assembly in place showing the camshaft and valve assembly and partially in section.
Figure 2:
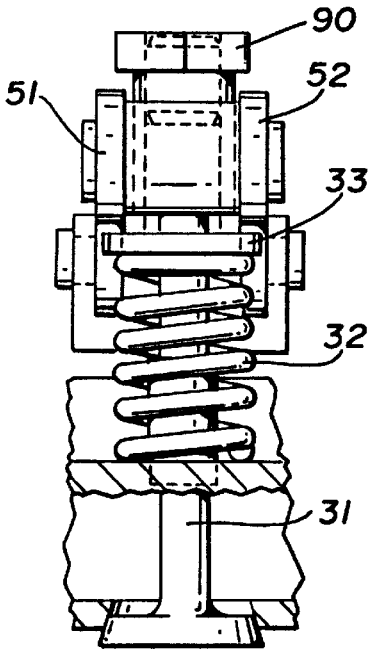
FIG. 2 is a sectional view taken along the line 2—2 of FIG. 1.

Referring first then to FIG. 1 of the drawings, it will be seen that the improved rocker arm assembly, generally indicated by the numeral 10, is mounted on the engine cylinder head 40 by the stud engaging assembly 80. The overall rocker arm assembly 10 also includes a pushrod engagement member 70 carried at one end for engagement with the pushrod, and valve stem engaging means carried at the opposed end of the rocker arm assembly for operation of the valve assembly 30.

Still referring to FIG. 1 of the drawings, it will be seen that the cam/pushrod arrangement 20, which includes the usual cam 21 of the camshaft, is provided and, in the form of the invention shown, engages a member 22 which has an oil-receiving cavity 22*a* so that as the camshaft 21 rotates in the direction of the arrow 21*a*, the pushrod 23, which has a hollow lubricant-receiving bore 23*a*, will move upwardly or be free to move downwardly, depending upon the area of the cam 21 which is in engagement with the undersurface of the member 22. This naturally causes the pushrod 23 to be raised or lowered.

The valve assembly 30 is illustrated as being of conventional design and includes a valve stem 31, a valve stem spring 32, and a retainer 33. The valve stem 31 has an upper end 31*a* which ultimately is intended to be engaged by the rocker arm and, in the form of the invention shown, is actually engaged by the roller 60 mounted on the end of the rocker arm assembly so as to effectuate a rolling contact rather than the usual sliding, friction-creating contact.

Figure 3:
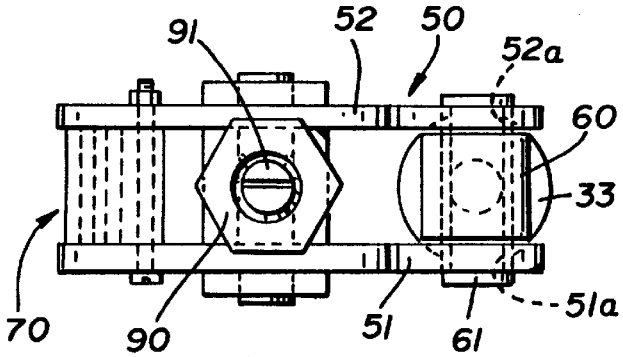
FIG. 3 is a sectional view taken along the line 3—3 of FIG. 1.
Figure 4:
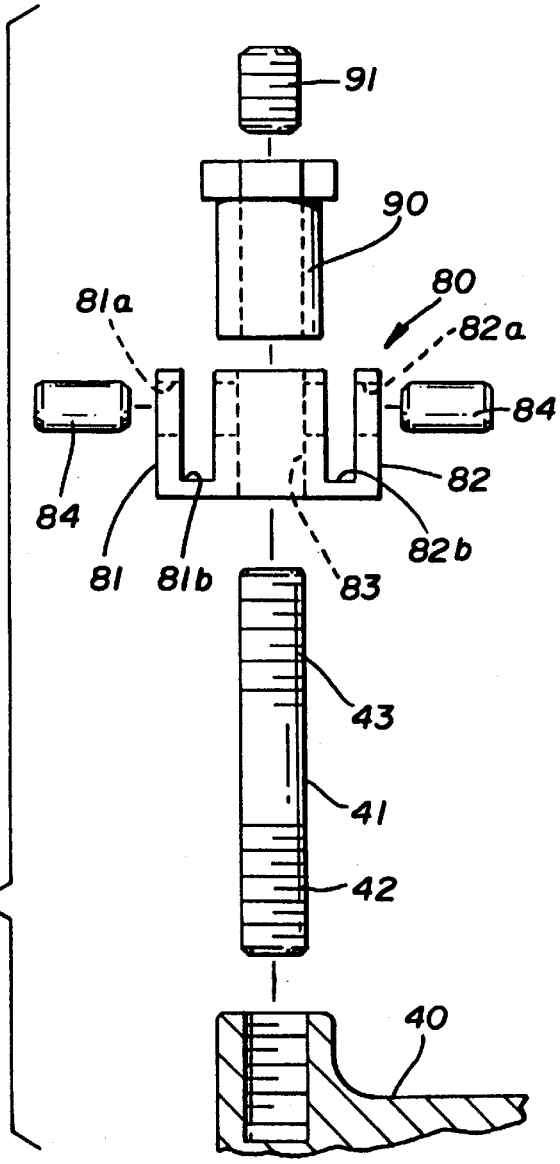
FIG. 4 is an exploded view, partially in section, showing the engine cylinder head mounting assembly.

Referring to FIGS. 1, 3 and 4 of the drawings, it will be seen that the engagement block assembly 80 is employed to mount the rocker arm assembly 10 to the engine cylinder head 40. In this regard, the engine cylinder head 40 is bored, as at 42, and receives a threaded end of the stud 41. A cube-shaped block (see FIG. 4) is provided and this block is, in end elevation, generally U-shaped in configuration, having opposed end walls 81 and 82, each of which is bored, as at 81*a* and 82*a*, for receipt of the pivot pins 84,84.

The central portion of the block also has a through central bore 83 running normally to bores 81*a*,82*a* which permits it to be slipped over the stud 41, as can be clearly seen in the drawings. Once stud 41 is in place and the block is slipped over the projecting end, pins 84,84 may be inserted to pivotally secure the opposed legs or plates to the block as shown in FIG. 3. Alternatively, pins 84,84 may be inserted prior to block 80 being assembled over stud 41.

It will also be noted that the rocker arm assembly 10 includes simple opposed legs 51 and 52 which can be produced in conventional fashion, such as, for example, by stamping. These are relatively thin, inexpensive and easy to fabricate, and it will be noted that the block 80 has recesses 81*b* and 82*b* so that the opposed legs 51 and 52 can be received in these recesses. Once this has been done and with the pins 84,84 in position, assuming that the stud 41 has been mounted on the engine block 40, as just described, the rocker arm assembly 10 can be slid onto the stud and will be in a position which will permit the rocker arm assembly 10 to pivot about the center axis of the pins 84,84 during operation, as will be described below.

Completing this assembly, it will be noted that an elongate nut 90 can be provided and threaded onto the end 43 of the stud 41 and be locked and held in place by the set screw 91. This secures the entire assembly in the condition shown in FIG. 1 of the drawings and prevents vibration-induced loosening.

One of the advantages of this arrangement is that the friction and heat buildup normally caused by the engagement of the hemispherical portion of the conventional rocker arm and the stud is minimized inasmuch as the stud engaging assembly provides a true pivoting relationship along the axes of the pins 84,84. Similarly, the elongate nut 90, which threads over the end of the stud, presents a fairly large mass of material which will also help to dissipate the heat buildup and thereby reduce wear as does block 80.

Turning next then to FIG. 3 of the drawings, it will be seen that, as previously noted, the rocker arm assembly includes the opposed elongate arms 51 and 52. Journalled between these at the one end adjacent the valve 30 is a roller 60 held in place by axle 61 which is received in the openings 51*a* and 52*a* of the opposed plates 51 and 52 of the rocker arm assembly. This permits the roller 60 to be carried for free rotation on this end of the rocker arm assembly 10 and, as can be seen in FIG. 1 of the drawings, this roller will engage the top surface 31*a* of the projecting end of the valve stem to depress it against the force of the spring 32 when the arm is rocked or pivoted to the down position by the pushrod 23 acting on its opposed end. However, a freewheeling or low friction engagement is achieved between the top end 31*a* of the valve stem and the roller 60.

Turning next then to FIGS. 1 through 8 of the drawings, it will be seen that a pushrod engagement assembly 70 is provided. This takes the form of a generally cube-shaped member which is received between the ends of the opposed legs 51 and 52 of the rocker arm assembly. It will be noted that there are several bores in this block which will now be described.

Figure 5:
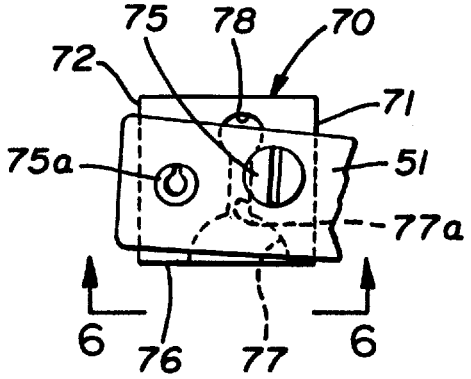
FIG. 5 is a partial elevational view of the pushrod engaging block assembly.
Figure 8:
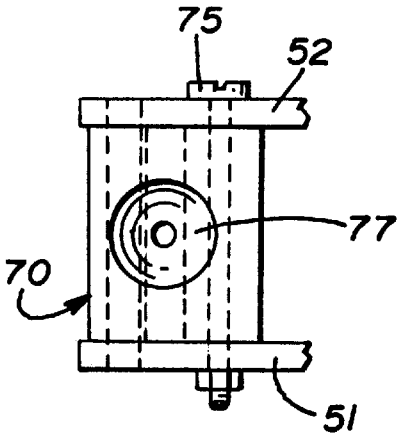
FIG. 8 is a sectional view taken along the line 8—8 of FIG. 7.
Figure 7:
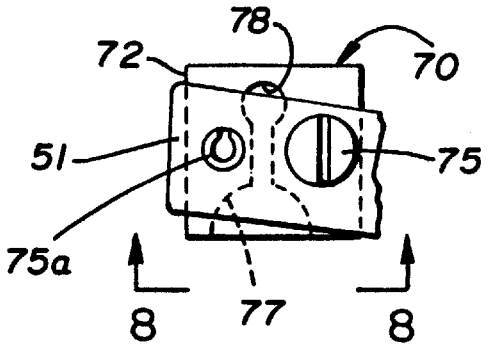
FIG. 7 is a further partial elevational view of the pushrod engaging block assembly in its alternative position.

First, a semicircular or hemispherical pocket 77 is provided in the bottom of the block, as shown in FIGS. 1, 5 and 7 of the drawings. This pocket is intended to provide a seat or engagement area for the top end 23*b* of the pushrod 23. It also, however, opens into the body of the engagement block 70. In that regard, it will be seen from FIGS. 5 and 7 of the drawings, for example, that a vertically extending bore 77*a* extends from pocket 77 and connects with a transverse bore 78. This permits lubricant from the pushrod to flow into the body of block 70 itself. That lubricant is then capable of lubricating the area of engagement between the rod 23 and the block and also is permitted to flow out of the block and down along the top surface of the opposed plates 51 and 52 of the arm body, thereby enhancing lubrication throughout the critical operational areas of the overall assembly.

Figure 6:
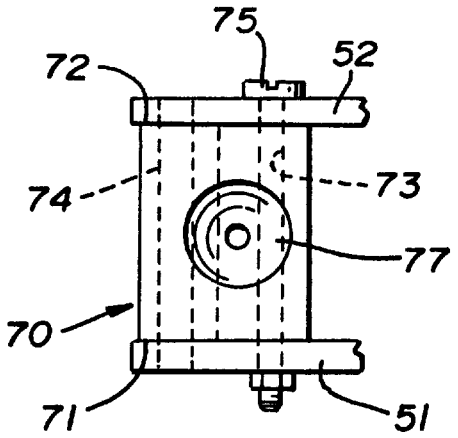
FIG. 6 is a sectional view taken along the line 6—6 of FIG. 5.

The block also has parallel transverse bores 73 and 74. In FIG. 6 of the drawings, it will be seen that an elongate nut and screw arrangement, generally indicated by the numeral 75, along with pin 75*a* are employed to secure the block 70 between the opposed plates 51 and 52 of the rocker arm assembly body. In this fashion, the center point of the opening 77 is located at a point a given distance from the central axes of the pins 84,84 or, in other words, from the pivot or fulcrum point.

If the block is reversed, as shown, for example, in FIG. 7 of the drawings, the center point of the semicircular recess 77 is moved a different distance from the fulcrum point, thereby changing the ratio. This feature makes it possible to change the ratio for performance purposes by simply reversing the block, thereby eliminating the necessity of buying a complete new set of rocker arms when performance is desired to be adjusted or modified.

It will thus been seen that the objects of the invention are achieved by the design disclosed herein. For example, the means of mounting the assembly to the engine cylinder head provides considerably more area in contact with the stud to dissipate heat and thereby minimize friction. It is also possible with this arrangement to lower the area of contact with the stud closer to the cylinder head. As noted above, in the conventional cast structure, the pivot point and point of greatest friction is farther spaced from the cylinder head by the thickness of the material used in the usual hemispherical arrangement.

The reversible feature just described with regard to the pushrod engagement assembly represents a substantial savings in cost to the user when it is desired to alter the performance characteristics.

Furthermore, the structure of the connecting block greatly improves the lubrication characteristics of the assembly.

While a full and complete description of the invention has been set forth in accordance with the dictates of the patent statutes, it should be understood that modifications can be resorted to without departing from the spirit of the invention or the scope of the appended claims.

Thus, if the reversibility of block 70 is not desired, the block could be riveted or spot welded to the arms of the rocker arm assembly which would then still maintain its antifriction characteristics and economy of fabrication.

What is claimed is:

1. A rocker arm assembly for use with a pushrod and a valve of an engine, comprising:

(a) an elongate rocker arm having
  (1) one end engaging a stem of the valve, and
  (2) an opposed end engaging the pushrod;

(b) a pushrod engaging member carried by said opposed end;

(c) a stud engaging assembly disposed between said one end of said rocker arm and said opposed end of said rocker arm and pivotally connected thereto;

(d) said pushrod engaging member including an engagement block releasably secured to said opposed end of said rocker arm; and (e) said engagement block including at least two parallel transverse bores extending between opposed sides thereof.

2. The assembly of claim 1 wherein a hollow roller is journalled on said one end of said rocker arm for engagement with said stem of the valve.

3. The assembly of claim 1 wherein said stud engaging assembly includes a block having a central stud receiving bore and at least one block support receiving bore extending transversely thereof; the longitudinal axes of said stud receiving bore and said at least one support receiving bore lying in planes normal to each other.

4. The assembly of claim 1 wherein said engagement block includes a pushrod engaging surface; and a lubrication bore opening into said block from said pushrod engaging surface.

5. The assembly of claim 4 wherein said pushrod engaging surface is offset from a centerline of said engagement block.

6. A rocker arm assembly for use with a pushrod and a valve of an engine, comprising:

(a) an elongate rocker arm comprising
  (1) an elongate body including parallel, spaced apart legs,
  (2) said legs having first and second ends and being pivotally mounted on the engine;

(b) pushrod engaging means carried by said first ends of said legs;

(c) valve stem engaging means carried by said second ends of said legs;

(d) stud engaging means disposed between said legs adjacent their longitudinal midpoints; and (e) said pushrod engaging means including a generally cube-shaped block disposed between said first ends of said legs and having at least two through mounting bores extending between first and second opposed, substantially parallel sides of said block.

7. The assembly of claim 6 wherein said stud engaging means include a mounting block receivable over a stud and pivotally attached to said legs adjacent their longitudinal midpoints.

8. The assembly of claim 6 wherein said block includes a third pushrod engaging side lying in a plane normal to said first and second sides and a lubrication passage means opening into said third side and into said first and second sides.

9. The assembly of claim 8 wherein said block includes two of said through mounting bores disposed in parrallel with each other.

10. The assembly of claim 6 wherein said valve stem engaging means include a hollow valve stem engaging roller journalled between said legs adjacent said second ends thereof.

11. The assembly of claim 8 wherein said pushrod engaging side has a pushrod engaging surface offset from a centerline of said block.

12. The assembly of claim 7 wherein said mounting block includes a stud receiving bore extending from a first surface to a second, opposed surface; and support receiving bores extending inwardly from third and fourth opposed surfaces; said third and fourth surfaces lying in parallel planes that are normal to the planes of said first and second surfaces.

13. The assembly of claim 12 further characterized by the presence of a locking nut receivable on the projecting end of the stud and engaging said block.

14. The assembly of claim 9 wherein said pushrod engaging block is removably and reversibly carried by said legs of said rocker whereby the distance between the pivotal mounting point of said rocker arm and said pushrod engaging side of said block may be altered.

* * * * *